US005670785A

United States Patent [19]

Kitamura

[11] Patent Number: 5,670,785

[45] Date of Patent: Sep. 23, 1997

[54] CHARGE CONVERTER PROVIDED IN AN ION IMPLANTATION APPARATUS

[75] Inventor: Yoshihiro Kitamura, Tokyo, Japan

[73] Assignee: NEC Corporation, Tokyo, Japan

[21] Appl. No.: 756,560

[22] Filed: Nov. 26, 1996

[30] Foreign Application Priority Data

Nov. 27, 1995 [JP] Japan ..... 7-307418

[51] Int. Cl.[6] ..... H01J 27/02

[52] U.S. Cl. ..... 250/423 R; 250/492.21

[58] Field of Search ..... 250/423 R, 424, 250/425, 492.21, 281, 282; 313/362.1

[56] References Cited

U.S. PATENT DOCUMENTS 4,298,798 11/1981 Huffman ..... 250/423 R 5,352,899 10/1994 Golovanivsky et al. ..... 250/442.21

*Primary Examiner*—Kiet T. Nguyen

*Attorney, Agent, or Firm*—Yound & Thompson

[57] ABSTRACT

A charge converter converts a positive ion into a negative ion. The charge converter is provided with a housing for containing a solid magnesium. A primary heater is also provided in the housing for heating up the solid magnesium to generate a sublimated evaporation of magnesium which fills within the housing. The housing is formed with a pair of beam passage holes through which a positive beam passes the housing. A secondary heater is further provided in the vicinity of the paired beam passage holes for heating the beam passage holes so as to prevent re-crystallization and adhesion of magnesium evaporation on an inner wall of each of the beam passage holes. A ternary heater may further optionally be provided entirely and uniformly around the housing for keeping a uniform distribution in temperature of the housing so as to keep a uniform temperature distribution of the solid magnesium to elongate a time during which the necessary magnesium evaporation is obtained. The above secondary heater may comprise a thermocouple-integrated heater for keeping a predetermined temperature at least in the vicinity of the beam passage holes of the charge converter.

10 Claims, 5 Drawing Sheets

CHARGE CONVERTER PROVIDED IN AN ION IMPLANTATION APPARATUS

BACKGROUND OF THE INVENTION

The present invention relates to a charge converter for converting positive ions into negative ions, and more particularly to a charge converter provided in an ion implantation apparatus with a tandem accelerator.

One of the conventional charge converters is disclosed in the Japanese laid-open patent publication No. 3-233843. The charge converter is provided in a negative ion generator which generates negative ions, wherein the charge converter converts the positive ions into the negative ions.

FIG. 1 is a schematic view illustrative of the above conventional charge converter. $BF_3$ gas or heating steams of solid phosphorus or arsenic is introduced via a gas introduction port 302 into an ion generator 301. The ion generator 301 is electrically connected to an ion generation power supply 303. The ion generator 301 also has a pair of an anode and a cathode, both of which are applied with an are voltage of about 50 V, which has been supplied by the ion generation power supply 303 to generate plasma in the ion generator 301 to cause desired positive ions.

The ion source 301 may be Freeman type ion source which generates plasma by a thermonic emission from a filament. A plug electrode 305 is provided, which has a potential lower by 20 kV to 50 kV from the potential of the ion source 301 so as to cause a positive ion beam from the ion source 301. A suppression electrode 304 is provided between the ion source 301 and the plug electrode 305 so that the suppression electrode 304 is set to have a potential lower by 1 kV to 5 kV from the potential of the ion source 301. The suppression electrode 304 serves as an electrostatic electrode lens which causes a convergence of the positive ion beam 306 in cooperation with the plug electrode 305.

The positive ion beam 306 has passed through the plug electrode 305 enters into a charge converter 307. The charge converter 307 is connected to an evaporation container 309 provided with a heater 308. The evaporation container 309 is filled with magnesium 310 which is heated by the heater 308 and red becomes a sublimated evaporation. The charge converter 307 is filled with a sublimated evaporation of magnesium 310 so that the positive ion beam 306 is changed into a negative ion beam 311 when passing through the charge converter 307. The positive ion beam 306 have collisions with the magnesium evaporation and receive electrons thereby become the negative ion beam 311.

The negative ion beam 311 is subjected to a mass separation by an analyzer 312 so that only a predetermined negative ion 313 passes through ground potential slits 317 and enters into a tandem section 314. In the tandem section 314, the negative ions 313 are accelerated by an electric field which generates a set of first electrodes 316. The accelerated negative ions 313 then enter into a charge converter 315 which is applied with a positive highest voltage. In the charge converter 315, $N_2$ gas has been introduced. The negative ions 313 have an interaction with the $N_2$ gas so that the negative ions 313 are converted into the positive ions 321. The positive ions 321 are then accelerated by an electric field generated by a set of second electrodes 319 and a pair of ground potential electrodes 320. The accelerated positive ions 321 are then enter into an energy filter 322 so that the positive ion 321 having only a predetermined energy is selected and introduced into a target 323.

In such tandem type negative ion generator, if the positive highest voltage, for example, 1000 kV is applied to the charge converter 315 and if the positive ion 321 is monovalence ion, then an acceleration energy of 2000 keV is obtained. If the positive ion 321 is divalent ion, then an acceleration energy of 3000 keV is obtained. This means that it is possible to obtain a maximum acceleration energy by a half of or one third of the corresponding voltage to the maximum acceleration energy. This further enable a reduction of an isolation distance and obtain a substantial size reduction of the negative ion generator.

The charge converter used in the tandem acceleration negative ion implantation apparatus will be described with reference to FIGS. 2 and 3. In a housing 403, a heater 405 and a cooling tube 406 are provided and a magnesium 404 is contained. The magnesium 404 is heated by the heater 405. The magnesium 404 is heated whereby the housing 403 is filled with a sublimated evaporation so that the positive ion beam having passed through a beam passing hole 407 is converted into a negative ion beam. This charge converter structurally differs from that illustrated in FIG. 1 in providing the heater 405 is provided within the housing 403 filled with the magnesium 404.

The positive ion beam enters through a suppression electrode 401 into the charge converter for convergence of the positive ion beam. The converged positive ion beam passes through a magnesium scavenging coup 408 and then enters via a beam passage hole 407 into the housing 403.

The magnesium 404 is heated and becomes a sublimated evaporation with which the housing 403 is filled. The positive ion beam has a collision with the sublimated evaporation of magnesium and receive electrons thereby the positive ion beam becomes a negative ion beam. This is, for example, disclosed in the Japanese laid-open patent publication No. 2-65034.

The above conventional charge converter causes a considerable reduction in an availability factor of the negative ion generator. As illustrated in FIG. 1, the heater 308 is provided on the exterior of the evaporation container 309 for heating the magnesium 310 contained in the evaporation container 309 to generate the sublimated evaporation of magnesium. Notwithstanding, the sublimated evaporation of magnesium is cooled in the vicinity of the beam passage hole 324 of the charge converter 307 and recrystallized and adhered on an inner wall of the charge converter 307. As a result, the beam passage hole 324 of the charge converter 307 is blocked with the adhered crystallization of magnesium The heater 308 is provided closer to the evaporation container 309, for which reason the evaporation container 309 in the vicinity of the heater 308 has a relatively high temperature but charge converter 307 particularly in the vicinity of the beam passage hole 324, far from the heater 308 has a relatively low temperature. The beam passage hole 324 of the relatively low temperature causes the recrystallization of the magnesium evaporation and adhesion onto the beam passage hole 324. As a result, the beam passage hole 324 is likely to be blocked with the re-crystallized magnesium whereby the re-crystallized magnesium adhered on the inner wall of the beam passage hole 324 prevents the positive ion beam 306 from passing through the charge converter 307, resulting in a reduction in formation amount of the negative ion beam 311. This makes it difficult to obtain the necessary amount of the negative ion beam 311. As a result, there is required a maintenance for removal of the adhered magnesium from the inner wall of the beam passage hole 324 to prevent beam passage hole 324 from being blocked with the re-crystallized magnesium. This causes a reduction in an availability factor of the negative ion generator.

The above problem is common to the charge converter as illustrated in FIGS. 2 and 3. In the vicinity of the heater 405, a temperature of the housing 403 is relatively high whilst in the vicinity of the beam passage hole 407 the temperature of the housing 403 is relatively low which cools the magnesium evaporation to cause a re-crystallization and adhesion thereof. After the charge converter has been operated 50 hours, the re-crystallized magnesium adhered on the inner wall of the beam passage hole 407 reduces the beam passage hole 407 in the diameter from 300 mm to 10 min. As a result, it is no longer possible to obtain the necessary beam current. In order to settle this problem, there is required a maintenance for removal of the recrystallized magnesium from the inner wall of the beam passage hole 407. This maintenance working is made by bringing the charge converter in a vacuum of a few Pa up to an atmospheric pressure of about $1\times10^6$ Pa and thereafter again returned into the vacuum pressure. For that reason, the sequential maintenance need about one day. In order to improve the availability factor of the negative ion generator, it is essential to eliminate such undesirable maintenance.

SUMMARY OF THE INVENTION

Accordingly, it is an object of the present invention to provide an improved charge converter free from the problems as described above.

It is a further object of the present invention to provide an improved charge converter with an improved availability factor.

It is a still further object of the present invention to provide an improved charge converter capable of preventing re-crystallization and adhesion of the magnesium evaporation on the beam passage hole.

It is yet a further object of the present invention to provide an improved charge converter capable of keeping a uniform temperature distribution of magnesium to elongate a time during which the necessary magnesium evaporation is obtained.

The above and other objects, features and advantages of the present invention will be apparent from the following descriptions.

The present invention provides a charge converter for converting a positive ion into a negative ion. The charge converter is provided with a housing for containing a solid magnesium. A primary heater is also provided in the housing for heating up the solid magnesium to generate a sublimated evaporation of magnesium which fills within the housing. The housing is formed with a pair of beam passage holes through which a positive beam passes the housing. A secondary heater is further provided in the vicinity of the paired beam passage holes for heating the beam passage holes so as to prevent re-crystallization and adhesion of magnesium evaporation on an inner wall of each of the beam passage holes. A ternary heater may further optionally be provided entirely and uniformly around the housing for keeping a uniform distribution in temperature of the housing so as to keep a uniform temperature distribution of the solid magnesium to elongate a time during which the necessary magnesium evaporation is obtained. The above secondary heater may comprise a thermocouple-integrated heater for keeping a predetermined temperature at least in the vicinity of the beam passage holes of the charge converter.

BRIEF DESCRIPTIONS OF THE DRAWINGS

Preferred embodiments of the present invention will be described in detail with reference to the accompanying drawings.

DISCLOSURE OF THE INVENTION

The present invention provides a charge converter for converting a positive ion into a negative ion. The charge converter is provided with a housing for containing a solid magnesium. A primary heater is also provided in the housing for heating up the solid magnesium to generate a sublimated evaporation of magnesium which fills within the housing. The housing is formed with a pair of beam passage holes through which a positive beam passes the housing. A secondary heater is further provided in the vicinity of the paired beam passage holes for heating the beam passage holes so as to prevent re-crystallization and adhesion of magnesium evaporation on an inner wall of each of the beam passage holes. A ternary heater may further optionally be provided entirely and uniformly around the housing for keeping a uniform distribution in temperature of the housing so as to keep a uniform temperature distribution of the solid magnesium to elongate a time during which the necessary magnesium evaporation is obtained. The above secondary heater may comprise a thermocouple-integrated heater for keeping a predetermined temperature at least in the vicinity of the beam passage holes of the charge converter.

The secondary heater heats the beam passage holes up to 400°–450° C. so as to prevent re-crystallization and adhesion of magnesium evaporation on an inner wall of each the beam passage holes to obtain an improvement in an availability factor of the charge converter.

PREFERRED EMBODIMENTS

Figure 1:
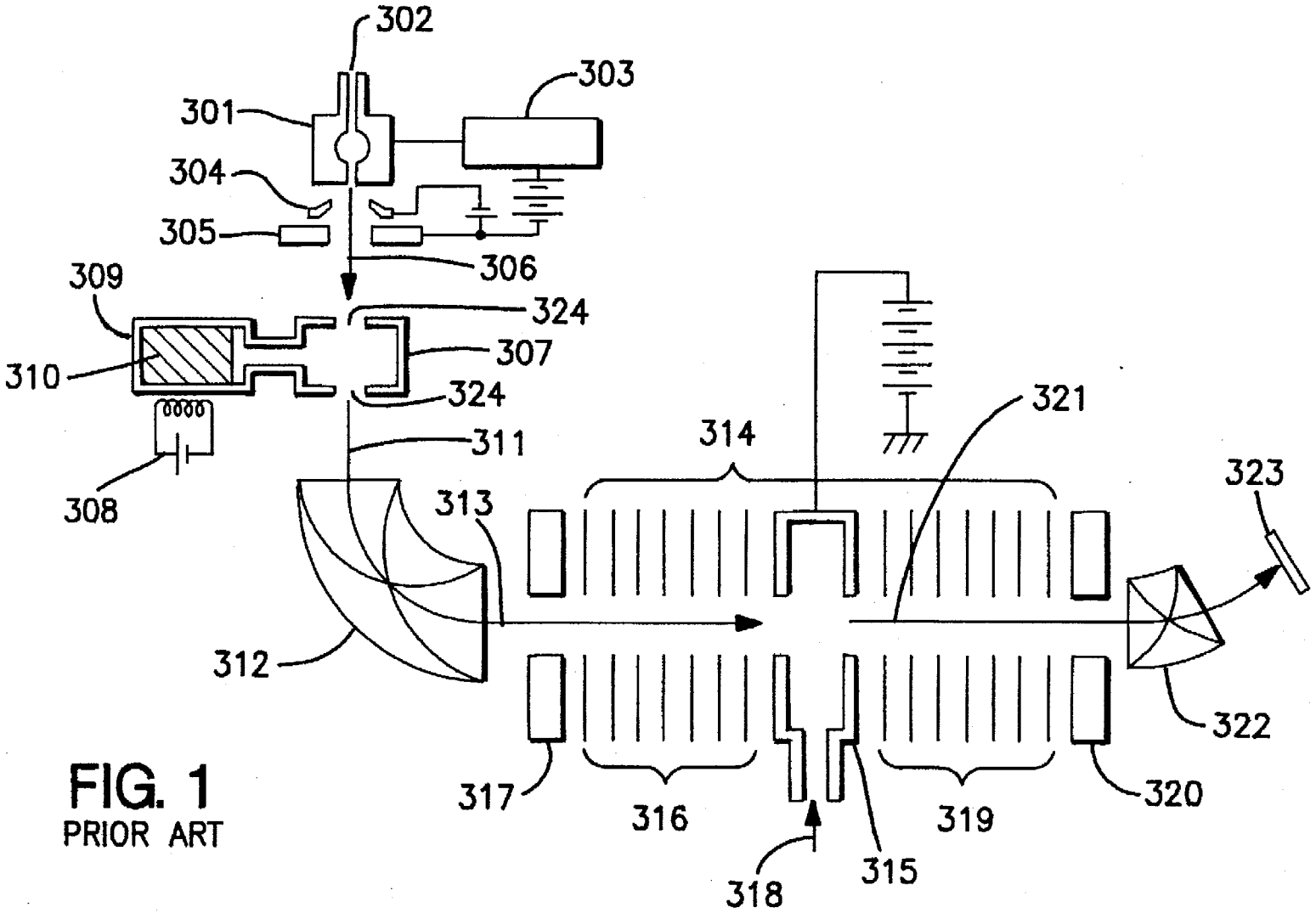
FIG. 1 PRIOR ART
FIG. 1 is a schematic view illustrative of a negative ion generator having the conventional charge converter.
Figure 2:
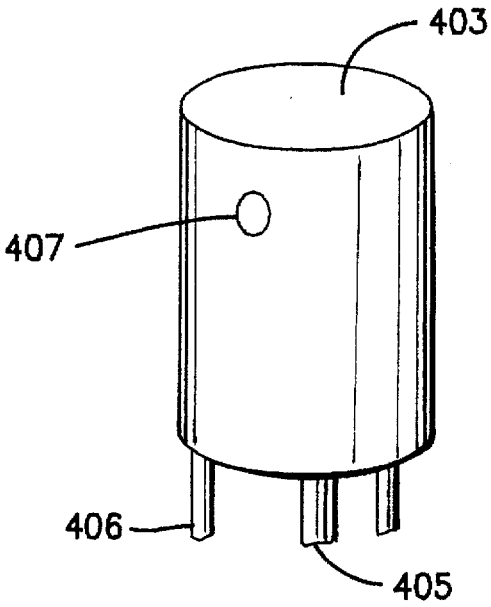
FIG. 2 PRIOR ART
FIG. 2 is a perspective view illustrative of the conventional charge converter.
Figure 4:
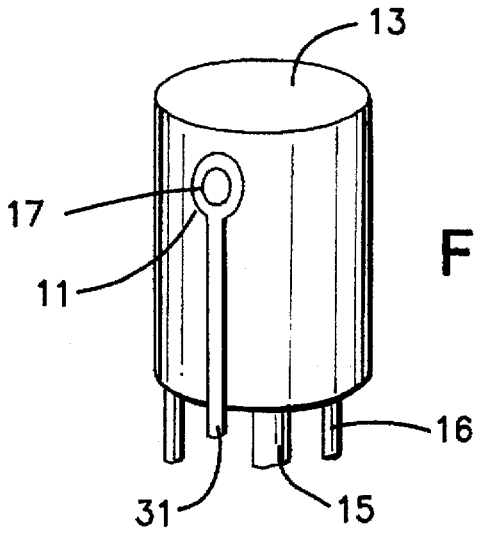
FIG. 4 is a perspective view illustrative of an improved charge converter in a first embodiment according to the present invention.
Figure 5:
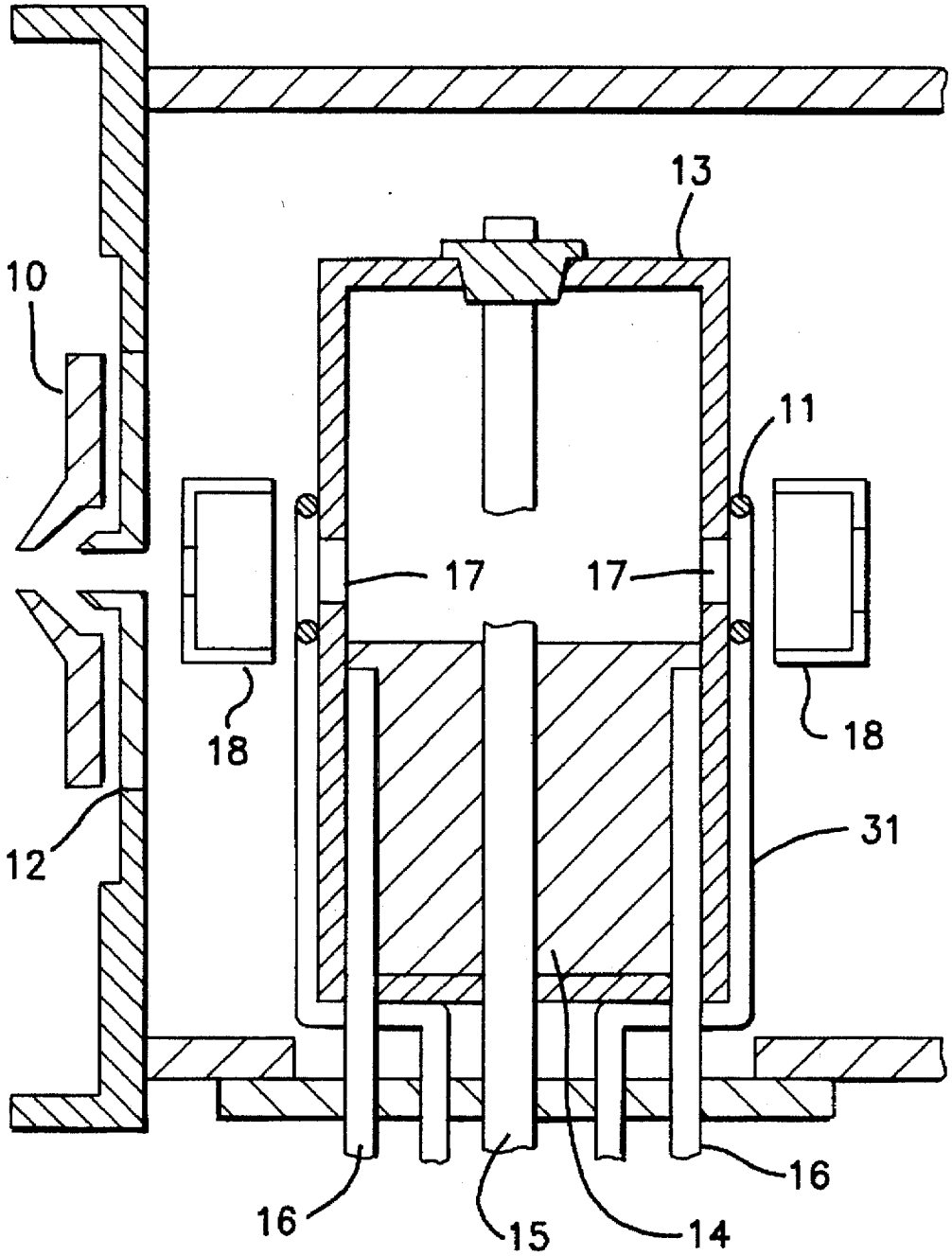
FIG. 5 is a cross sectional elevation view illustrative of an improved charge converter in a first embodiment according to the present invention.

A first embodiment according to the present invention will be described with reference to FIGS. 4 and 5, wherein an improved charge converter is provided. The charge converter comprises a housing 13 which is cylindrically shaped. The cylindrically shaped housing 13 has opposite ends closed with metal materials. The cylindrically shaped housing 13 contains a solid magnesium 14. A primary heater 15 is provided within the cylindrically shaped housing 13 for heating the solid magnesium 14 to generate sublimated evaporation of magnesium. The primary heater 15 vertically extends along a center vertical axis of the cylindrically shaped housing 13. The cylindrically shaped housing 13 is filled with the solid magnesium 14 below a predetermined level thereof and a space is formed in the cylindrically shaped housing 13 above the predetermined level. The primary heater 15 thus vertically extends to penetrate the solid magnesium 14 and the space formed over the solid magnesium 14. The primary heater 15 heats up the solid magnesium 14 to generate sublimated evaporation of magnesium with which the space over the solid magnesium 14 and within the housing 14 is filled. A plurality of cooling tubes 16 are provided which vertically extend along an inner wall of the housing 13 but below the predetermined level of the housing 14. Namely, the cooling tubes 16 are immersed in the solid magnesium 14. The primary heater 15 may comprise an electric heater, whilst the cooling tubes 16 may be air cooler. A pair of beam passage holes 17 are provided at diametrically opposite ends of the cylindrically shaped housing 13. The beam passage holes 17 are positioned above the predetermined level below which the cylindrically shaped housing 13 is filled with the solid magnesium 14. A pair of secondary heaters 11 are provided to extend on an outer wall of the cylindrically shaped housing 13 and at the diametrically opposite ends thereof. Each the secondary heaters 11 is annular-shaped to encompass the beam passage hole 17 so as to heat up each the beam passage hole 17. A thermocouple is integrated in each the secondary heaters 11. Each of the secondary heaters 11 is connected to a heater wiring which vertically extends from the bottom of the cylindrically shaped housing 13 up to in the vicinity of the beam passage hole 17. The secondary heaters 11 are heated up to a temperature in the range of about 400°–450° C. The primary heater 15 is heated up to a temperature of about 400° C. for heating the solid magnesium to generate sublimated evaporation of magnesium with which the space over the solid magnesium 14 and within the housing 13 is filled. As described above, since the secondary heaters 11 are heated up to a temperature in the range of about 400°–450° C., no recrystallization and nor adhesion of magnesium appears in the vicinity of the beam passage holes 17. A pair of magnesium scavenging cups 18 are provided outside of the paired beam passage holes 17, wherein the magnesium scavenging cups 18 are close to the beam passage holes 17 but separated therefrom. A plug electrode 12 is provided outside of one of the paired magnesium scavenging cups 18, wherein the plug electrode 12 is close to the beam passage hole 17 but separated therefrom. A suppression electrode 10 is provided outside of the plug electrode 12, wherein the suppression electrode 10 is close to the plug electrode 12 but separated therefrom. The positive ion beam is converged by the suppression electrode 10 and the plug electrode 12 before entry through the magnesium scavenging cup 18 and the beam passage hole 17 into the housing space filled with the sublimated evaporation of magnesium so that the positive ion beam has a collision with the sublimated evaporation of magnesium whereby the positive ions receive electrons from the sublimated evaporation of magnesium during the collision between them and become negative ions. Since secondary heaters 11 are heated up to a temperature in the range of about 400°–450° C., no re-crystallization and nor adhesion of magnesium appears in the vicinity of the beam passage holes 17 to obtain an improvement in an availability factor of the charge converter. In the conventional charge converter, a maintenance free operable time is about 50 hours. By contrast in the above improved charge converter, the maintenance free operable time is about 100 hours.

Figure 6:
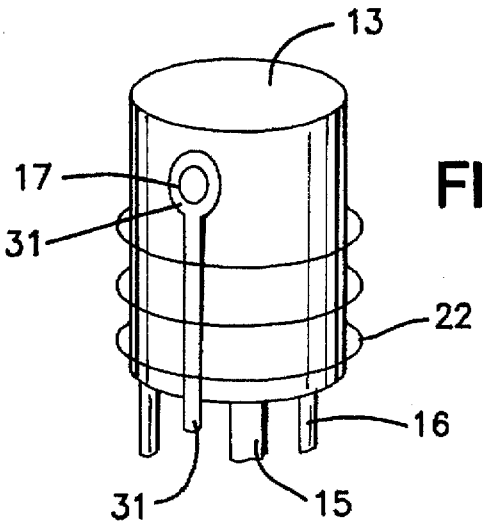
FIG. 6 is a perspective view illustrative of an improved charge converter in a second embodiment according to the present invention.
Figure 3:
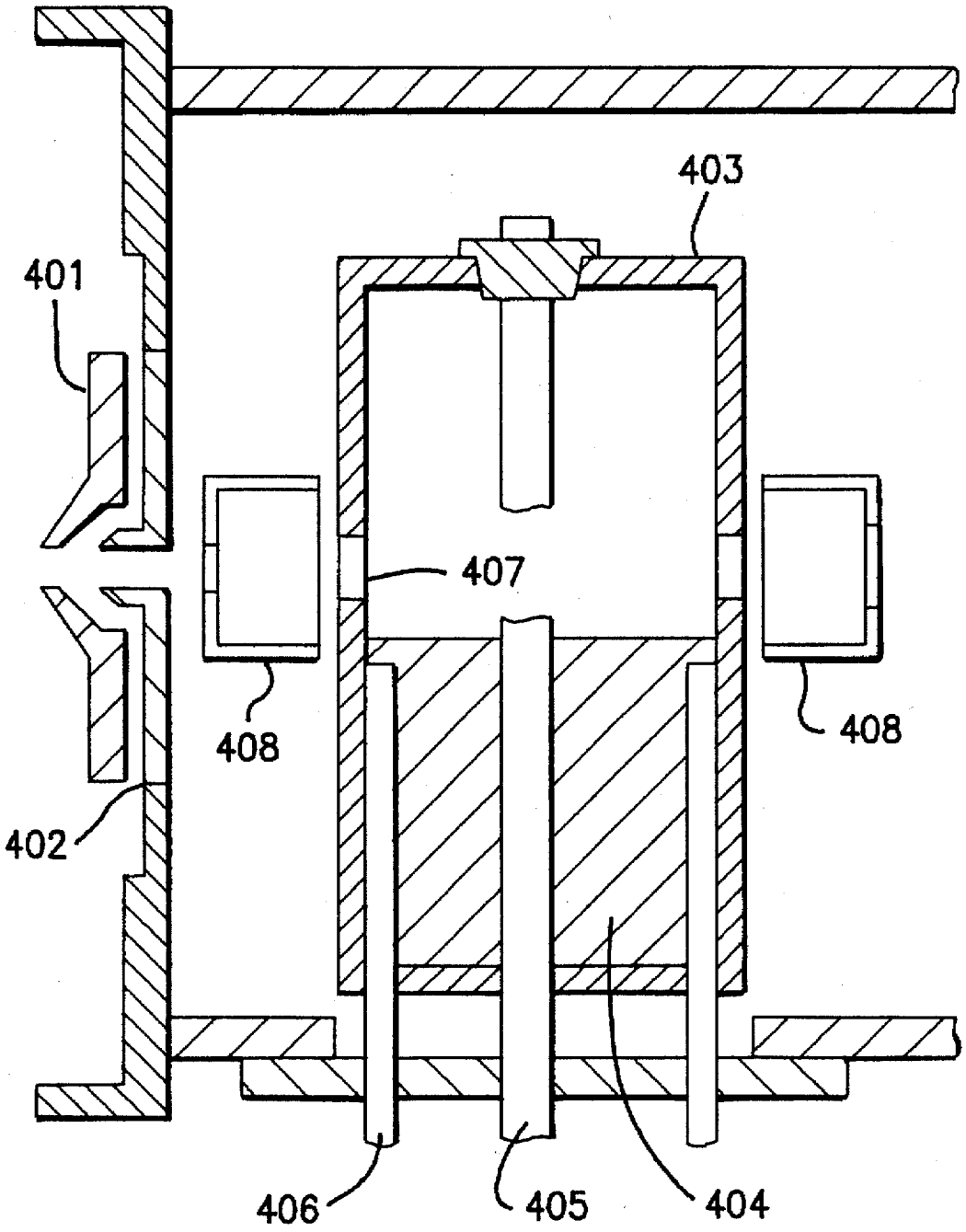
FIG. 3 PRIOR ART
FIG. 3 is a cross sectional elevation view illustrative of the conventional charge converter.
Figure 7:
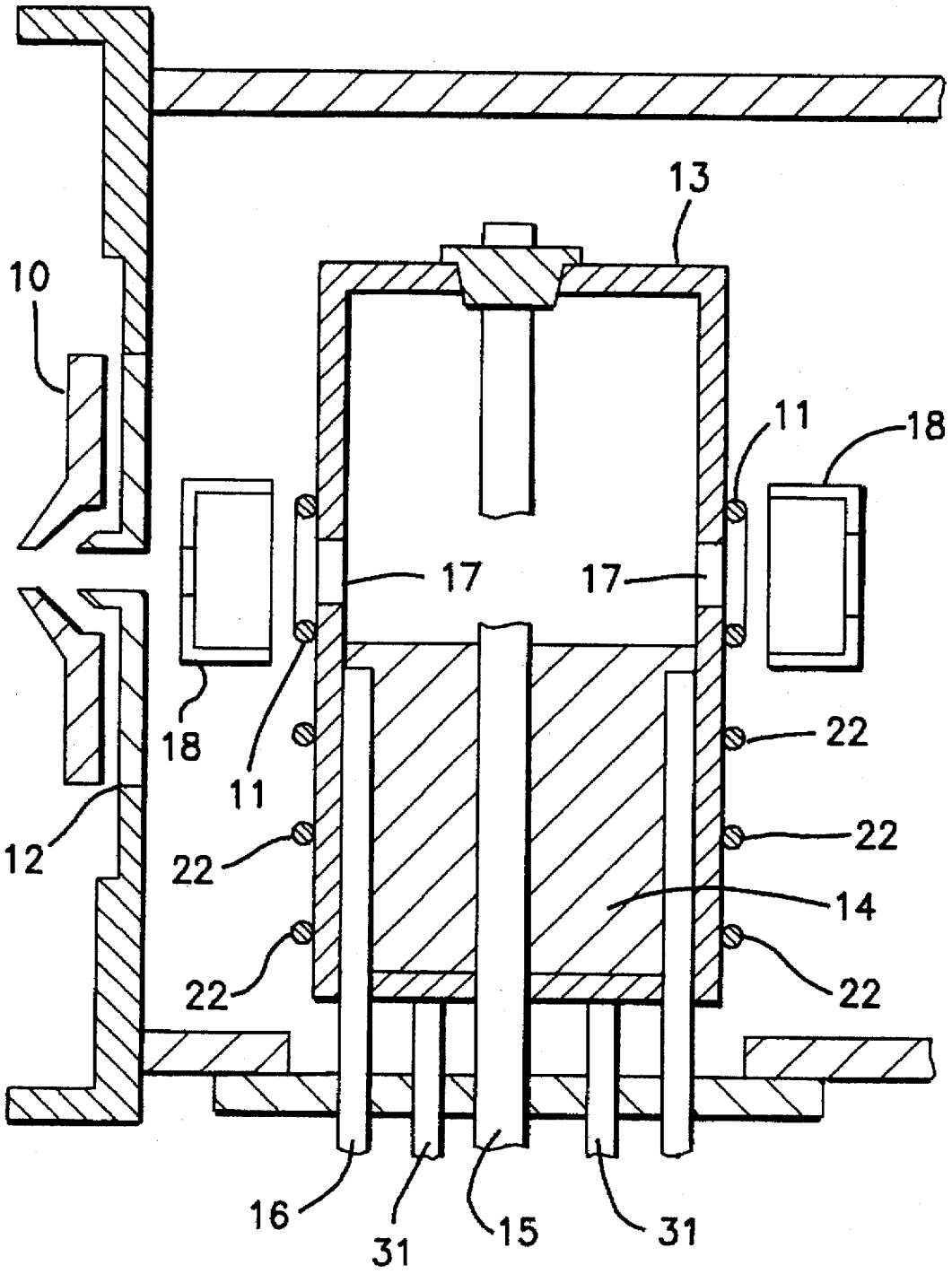
FIG. 7 is a cross sectional elevation view illustrative of an improved charge converter in a second embodiment according to the present invention.

A second embodiment according to the present invention will be described with reference to FIGS. 6 and 7, wherein an improved charge converter is provided which structurally differs from that in the first embodiment only in further providing a ternary heater for keeping a uniform distribution in temperature of the housing so as to keep a uniform temperature distribution of the solid magnesium to elongate a time during which the necessary magnesium evaporation is obtained.

The charge converter thus comprises a housing 13 which is cylindrically shaped. The cylindrically shaped housing 13 has opposite ends closed with metal materials. The cylindrically shaped housing 13 contains a solid magnesium 14. A primary heater 15 is provided within the cylindrically shaped housing 13 for heating the solid magnesium 14 to generate sublimated evaporation of magnesium. The primary heater 15 vertically extends along a center vertical axis of the cylindrically shaped housing 13. The cylindrically shaped housing 13 is filled with the solid magnesium 14 below a predetermined level thereof and a space is formed in the cylindrically shaped housing 13 above the predetermined level. The primary heater 15 thus vertically extends to penetrate the solid magnesium 14 and the space formed over the solid magnesium 14. The primary heater 15 heats up the solid magnesium 14 to generate sublimated evaporation of magnesium with which the space over the solid magnesium 14 and within the housing 14 is filled. A plurality of cooling tubes 16 are provided which vertically extend along an inner wall of the housing 13 but below the predetermined level of the housing 14. Namely, the cooling tubes 16 are immersed in the solid magnesium 14. The primary heater 15 may comprise an electric heater, whilst the cooling tubes 16 may be air cooler. A pair of beam passage holes 17 are provided at diametrically opposite ends of the cylindrically shaped housing 13. The beam passage holes 17 are positioned above the predetermined level below which the cylindrically shaped housing 13 is filled with the solid magnesium 14. A pair of secondary heaters 11 are provided to extend on an outer wall of the cylindrically shaped housing 13 and at the diametrically opposite ends thereof. Each the secondary heaters 11 is annular-shaped to encompass the beam passage hole 17 so as to heat up each the beam passage hole 17. A thermocouple is integrated in each the secondary heaters 11. Each of the secondary heaters 11 is connected to a heater wiring which vertically extends from the bottom of the cylindrically shaped housing 13 up to in the vicinity of the beam passage hole 17. A ternary heater 22 is provided spiral rounding the cylindrically shaped housing 13 at almost the constant pitch but below the predetermined level so that the ternary heater 22 encompasses the solid magnesium 14 for keeping a uniform distribution in temperature of the housing below the predetermined level. The ternary heater 22 is heated up to a temperature in the range of about 400°–450° C. so as to keep a uniform temperature distribution of the solid magnesium to elongate a time during which the necessary magnesium evaporation is obtained. The secondary heaters 11 are heated up to a temperature in the range of about 400°–450° C. The primary heater 15 is heated up to a temperature of about 400° C. for heating the solid magnesium to generate sublimated evaporation of magnesium with which the space over the solid magnesium 14 and within the housing 13 is filled. As described above, since the secondary heaters 11 are heated up to a temperature in the range of about 400°–450° C., no re-crystallization and nor adhesion of magnesium appears in the vicinity of the beam passage holes 17. A pair of magnesium scavenging cups 18 are provided outside of the paired beam passage holes 17, wherein the magnesium scavenging cups 18 are close to the beam passage holes 17 but separated therefrom. A plug electrode 12 is provided outside of one of the paired magnesium scavenging cups 18, wherein the plug electrode 12 is close to the beam passage hole 17 but separated therefrom. A suppression electrode 10 is provided outside of the plug electrode 12, wherein the electrode 12 but electrode 10 is close to the plug electrode 12 but separated therefrom. The positive ion beam is converged by the suppression electrode 10 and the plug electrode 12 before entry through the magnesium scavenging cup 18 and the beam passage hole 17 into the housing space filled with the sublimated evaporation of magnesium so that the positive ion beam has a collision with the sublimated evaporation of magnesium whereby the positive ions receive electrons from the sublimated evaporation of magnesium during the collision between them and become negative ions. Since secondary heaters 11 are heated up to a temperature in the range of about 400°–450° C., no re-crystallization and nor adhesion of magnesium appears in the vicinity of the beam passage holes 17 to obtain an improvement in an availability factor d the charge converter. In the conventional charge converter, a maintenance free operable time is about 50 hours. By contrast, in the above improved charge converter, the maintenance free operable time is about 100 hours. Further, the ternary heater 22 is heated tip to a temperature in the range of about 400°–450° C. so as to keep a uniform temperature distribution of the solid magnesium to elongate a time during which the necessary magnesium evaporation is obtained. In the conventional charge converter, a maintenance free operable time is about 50 hours. By contrast, in the above improved charge converter, the maintenance free operable time is about 100 hours.

Whereas modifications of the present invention will be apparent o a person having ordinary skill in the art, to which the invention pertains, it is to be understood that embodiments as shown and described by way of illustrations are by no means intended to be considered in a limiting sense. Accordingly, it is to be intended to cover by claims any modifications of the present invention which fall within the spirit and scope of the present invention.

What is claimed is:

1. A charge converter for convening a positive ion into a negative ion, said charge converter comprising:

a housing for converting a solid magnesium;

a primary heater provided in said housing for heating up said solid magnesium to generate a sublimated evaporation of magnesium which fills within said housing;

a pair of beam passage holes provided on said housing so that a positive ion beam enters through one of said beam passage holes into said housing and a negative ion beam outputs from the other of said beam passage holes; and a secondary heater provided in the vicinity of said beam passage hole for heating said beam passage hole to suppress re-crystallization and adhesion of said magnesium evaporation on an inner wall of each of said beam passage holes.

2. The charge converter as claimed in claim 1, wherein said secondary heater comprises a thermocouple-integrated heater for keeping a predetermined temperature in the vicinity of said beam passage hole of said charge converter.

3. The charge converter as claimed in claim 1, wherein said secondary heater is annular-shaped to encompass said beam passage hole.

4. The charge converter as claimed in claim 1, further comprising a ternary heater provided entirely and uniformly around said housing for keeping a uniform distribution in temperature of said housing so as to keep a uniform temperature distribution of said solid magnesium.

5. The charge converter as claimed in claim 4, wherein said ternary heater is provided spiral rounding said housing.

6. A charge converter for converting a positive ion into a negative ion, said charge converter comprising:

a housing cylindrically shaped and having opposite ends closed with metal materials for containing a solid magnesium, said housing being filled with said solid magnesium at a predetermined level thereof and a space being formed in said housing over said predetermined level;

a primary heater provided in said housing for heating up said solid magnesium to generate a sublimated evaporation of magnesium which fills within said housing, said primary heater vertically extending along a center vertical axis of said cylindrically shaped housing;

a pair of beam passage holes provided on said housing so that a positive ion beam enters through one of said beam passage holes into said housing and a negative ion beam outputs from the other of said beam passage holes; and a secondary heater provided in the vicinity of said beam passage hole for heating said beam passage hole to suppress re-crystallization and adhesion of said magnesium evaporation on an inner wall of each of said beam passage holes.

7. The charge converter as claimed in claim 6, wherein said secondary heater comprises a thermocouple-integrated heater for keeping a predetermined temperature in the vicinity of said beam passage hole of said charge converter.

8. The charge converter as claimed in claim 6, wherein said secondary heater is annular-shaped to encompass said beam passage hole.

9. The charge converter as claimed in claim 6, further comprising a ternary heater provided entirely and uniformly around said housing for keeping a uniform distribution in temperature of said housing so as to keep a uniform temperature distribution of said solid magnesium.

10. The charge converter as claimed in claim 9, wherein said ternary heater is provided spiral rounding said housing.

* * * * *